US007064644B2

(12) United States Patent
Weber et al.

(10) Patent No.: US 7,064,644 B2
(45) Date of Patent: Jun. 20, 2006

(54) WINDING FOR A TRANSFORMER OR A COIL AND METHOD FOR WINDING

(75) Inventors: Benjamin Weber, Winterberg (DE); Karl Zillmann, Marsberg (DE); Thomas J. Lanoue, Cary, NC (US); Hans-Jürgen Buss, Brilon (DE); Harald Younger, Halifax, VA (US)

(73) Assignee: ABB T & D Technologies Ltd., Zurich (CH)

( * ) Notice: Subject to any disclaimer, the term of this patent is extended or adjusted under 35 U.S.C. 154(b) by 359 days.

(21) Appl. No.: 10/304,118

(22) Filed: Nov. 25, 2002

(65) Prior Publication Data

US 2003/0156004 A1 Aug. 21, 2003

(30) Foreign Application Priority Data

Nov. 23, 2001 (DE) ..... 101 57 591

(51) Int. Cl.
*H01F 5/00* (2006.01)

(52) U.S. Cl. ..... 336/200; 336/205; 336/206; 336/207; 336/208; 336/223; 336/185; 336/186; 29/602.1

(58) Field of Classification Search ..... 336/200, 336/185, 199, 205, 206, 207, 208, 223, 232, 336/187, 186, 183, 213, 221; 59/602.1
See application file for complete search history.

(56) References Cited

U.S. PATENT DOCUMENTS 3,928,832 A 12/1975 Forsberg et al. ..... 336/70
5,508,674 A * 4/1996 Girgis et al. ..... 336/187
6,433,664 B1 * 8/2002 Ishii et al. ..... 336/185

FOREIGN PATENT DOCUMENTS

| | | |
|---|---|---|
| DE | 1 819 904 | 10/1960 |
| DE | 32 12 060 A1 | 10/1983 |
| DE | 34 14 301 A1 | 8/1985 |
| DE | 3414301 A1 * | 8/1985 |
| DE | 198 54 439 C2 | 6/2000 |
| GB | 2 118 483 A | 11/1983 |

* cited by examiner

*Primary Examiner*—Lincoln Donovan
*Assistant Examiner*—Jennifer A. Poker
(74) *Attorney, Agent, or Firm*—Laurence A. Greenberg; Werner H. Stemer; Ralph E. Locher

(57) ABSTRACT

A winding for a transformer or a coil having a ribbon electrical conductor and an insulating material layer composed of ribbon insulation material wound jointly to form turns around a winding core. The individual turns of the winding have a predetermined winding angle with respect to a winding axis of the winding core and are disposed such that they partially overlap one another. An insulating layer is inserted between two radially adjacent layers of the turns. Furthermore, a thickness of the insulating layer is locally matched to the voltage difference determined there. In addition, the thickness of the insulating layer is locally matched, the thickness being interchanged in sequence of the method A+B determined there, to the voltage difference between the two relevant radially adjacent layers at the relevant axial point.

10 Claims, 3 Drawing Sheets

WINDING FOR A TRANSFORMER OR A COIL AND METHOD FOR WINDING

BACKGROUND OF THE INVENTION

Field of the Invention

The invention relates to a winding for a transformer or a coil having a ribbon electrical conductor and having an insulating material layer of ribbon insulation material, which are wound jointly to form turns (also referred to as windings) around a winding core, with the individual turns of the winding having a predetermined winding angle with respect to the winding axis of the winding core, and being disposed such that they partially overlap one another, and with an insulating layer being inserted between two radially adjacent layers of turns.

In generally available windings such as these, the turns are normally wound such that they lie closely alongside one another in the axial direction, and at least one layer of turns is formed.

Frequently, however, a number of layers are also joined to one another radially and form a multilayer transformer or a multilayer coil. In situations where there are a number of layers of turns an insulating layer is in each case frequently introduced or inserted between two adjacent layers. The insulating layer prevents voltage flashovers between the layers, and is, accordingly, configured for the maximum voltage difference that can exist between two layers.

SUMMARY OF THE INVENTION

It is accordingly an object of the invention to provide a winding for a transformer or a coil that overcomes the hereinafore-mentioned disadvantages of the heretofore-known devices and methods of this general type in which insulation material can be saved and in which, furthermore, an adequate withstand voltage is achieved, and, in particular, provides a good impulse withstand voltage between two radially adjacent layers of turns.

With the foregoing and other objects in view, there is provided, in accordance with the invention, a winding for at least one of a transformer and a coil, including a winding core having a winding axis, a ribbon electrical conductor, an insulating material layer of ribbon insulation material, the ribbon electrical conductor and the insulating material layer being wound jointly to form turns around the winding core, individual ones of the turns of the winding being disposed to partially overlap one another and having a predetermined winding angle with respect to the winding axis and at least one of a local voltage differences and a voltage difference profile between each respective one of two radially adjacent layers of the turns in a direction of the winding axis, and insulating layers, at least one of the insulating layers disposed between each of two radially adjacent layers of the turns, each of the insulating layers having a thickness locally matched to respective one of the at least one local voltage differences and the voltage difference profile.

According to the invention, the local voltage differences and/or a voltage difference profile between the two relevant radially adjacent layers in the direction of the winding axis are or is determined, and the thickness of the insulating layer is locally matched to the determined voltage difference in each case. The insulating layer is, therefore, not configured, as in the prior art, with a constant layer thickness, but the thickness is matched to the voltage difference between the relevant radially adjacent rows. It is, therefore, possible to save insulation material at the axial points at which the voltage difference is comparatively low. Furthermore, this means that the transformer or the coil may have a comparatively better impulse withstand voltage between the layers, overall.

In accordance with another feature of the invention, for a configuration of two radially adjacent insulating layers, is for the calculated overall thickness of these two insulating layers to have approximately the same thickness at every axial point. Such a refinement advantageously results in the different external diameters of a layer, which result from the different insulating layer thicknesses, being compensated for, once again, by the profile, according to the invention, of a further insulating layer between that layer and the next subsequent layer, thus, resulting in the transformer or the coil having the same external diameter overall.

In accordance with a further feature of the invention, the insulating layers are disposed offset with respect to one another in a direction of the winding axis.

In accordance with an added feature of the invention, the thickness change in the insulating layer is continuous in the axial direction. Such a configuration results in the insulating layer having an approximately wedge-shaped profile, when seen in the form of a section through the winding axis. However, it is possible, without any problems, to provide a sawtooth or corrugated profile in section, for example, when two coils are disposed directly alongside one another.

However, it is particularly advantageous for the thickness change in the insulating layer to be in the form of steps in the axial direction. This means that, seen in the axial direction, the thickness of the insulating layer changes suddenly in steps, that is to say, discontinuously, without this having any disadvantageous effect on the withstand voltage. Furthermore, such a refinement means that the insulating layer can be produced in a considerably simpler manner, with the conventional ribbon insulation material being wound layer-by-layer to form the insulating layer.

In accordance with an additional feature of the invention, there is provided a

In accordance with yet another feature of the invention, before the turns are wound, the electrical conductor is connected to the insulating material layer or coated with an insulating varnish.

In accordance with yet a further feature of the invention, the electrical conductor connected to the insulating material layer.

In accordance with yet an added feature of the invention, the electrical conductor is insulating varnish coated.

With the objects of the invention in view, there is also provided a method for producing a winding for at least one of a transformer and a coil, including the steps of jointly winding a ribbon electrical conductor and an insulating material layer of ribbon insulation material to form turns around a winding core having a winding axis, each of the individual turns of the winding having a predetermined winding angle with respect to the winding axis and being disposed to partially overlap one another, inserting an insulating layer between each two radially adjacent layers of the turns, determining at least one of local voltage differences and a voltage difference profile between two respective adjacent ones of the radially adjacent layers in a direction of the winding axis, and locally matching a thickness of the insulating layer to a respective determined at least one of the local voltage differences and the voltage difference profile.

Other features that are considered as characteristic for the invention are set forth in the appended claims.

Although the invention is illustrated and described herein as embodied in a winding for a transformer or a coil, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
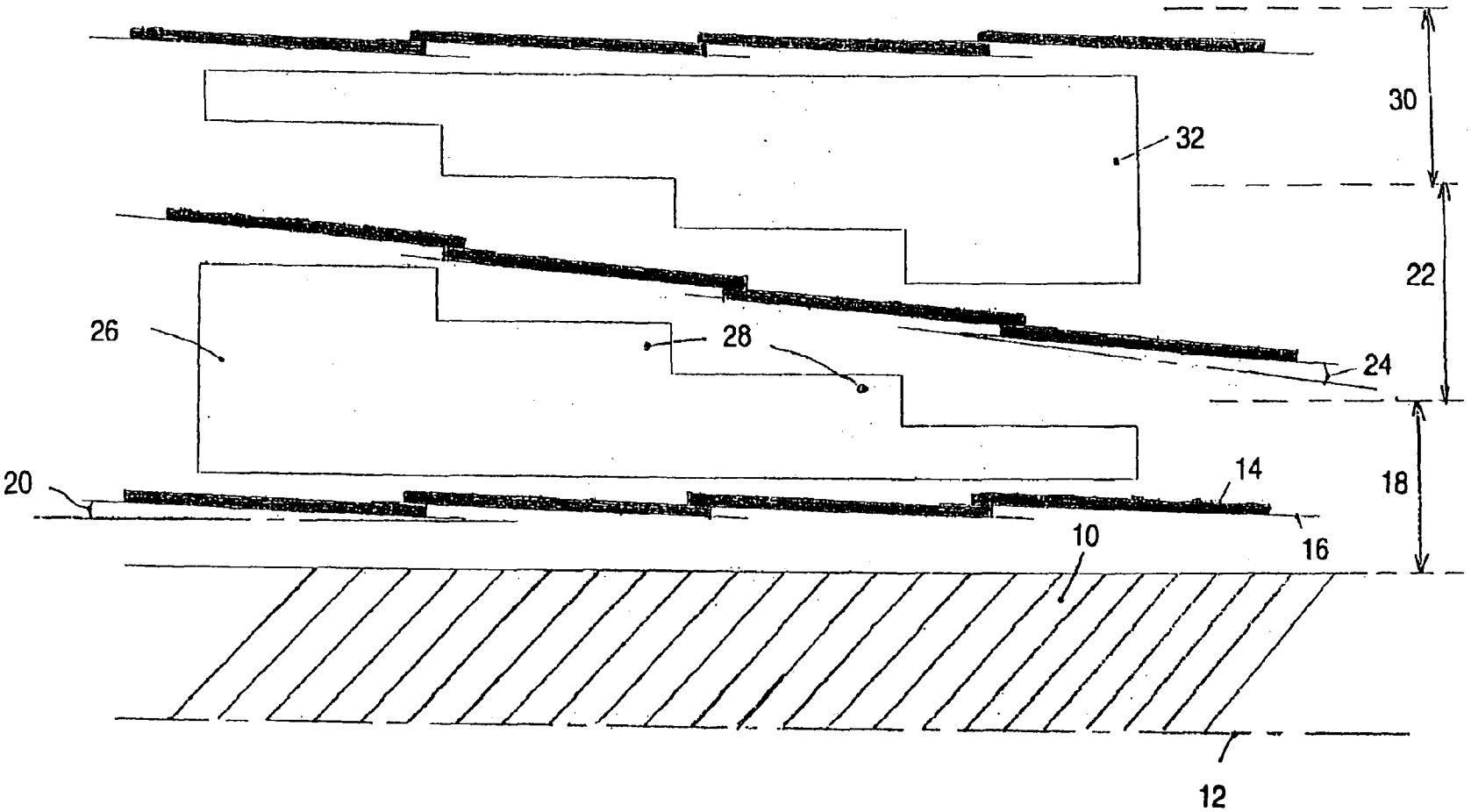
FIG. 1 is a fragmentary, cross-sectional view of a transformer winding according to the invention with three layers.

Referring now to the figures of the drawings in detail and first, particularly to FIG. 1 thereof, there is shown part of a three-layer winding for a transformer. The winding is wound around a winding core 10, with a winding axis 12. The winding is formed from a ribbon electrical conductor 14, which is coated with a ribbon insulation material 16. As an alternative to such a configuration, the ribbon insulation material 16 may also be in the form of a ribbon film. Furthermore, it is irrelevant whether the electrical conductor 14 is coated with the insulation material, or whether the insulation material is formed as a ribbon in its own right, together with the electrical conductor 14, to form the winding.

That layer that is wound directly around the winding core 10 will be referred to as the first layer 18 of turns. The ribbon insulation material 16 is, in such a case, disposed such that it is located between the winding core 10 and the conductor 14. The individual turns of the first layer 18 are inclined through a specific angle 20 with respect to the winding axis 12. Furthermore, each turn is disposed offset by a specific amount with respect to the previous winding, parallel to the direction of the winding axis 12, such that a next subsequent winding partially overlaps the preceding turn. A second layer 22 of turns is wound radially around the first layer 18. The winding structure of the second layer 22 corresponds substantially to the winding structure of the first layer 18 so that, in this case, as well, the electrical conductor 14 and the insulation material 16 are configuration such that they partially overlap, being disposed turn-by-turn alongside one another. The axial orientation of the overlaps of the first layer 18 and of the second layer 22 is chosen such that they come to rest at the same axial point on the winding axis 12. The nature of the overlap in the second layer 22 is chosen such that a winding angle 24 of the second layer 22 corresponds to the magnitude of the specific angle 20, but with a negative angle orientation. From the mathematical viewpoint, this means that the winding angle 24 corresponds to an angle of 180° C. minus the specific angle 20, assuming that the winding axis 12 is regarded as zero angle.

A first insulation layer 26 is disposed between the second layer 22 and the first layer 18 and, in this view, has an approximately wedge-shaped section. The first corner of the wedge, which has the acute angle, is disposed at a first end of the winding axis 12, and the broad side, which is located opposite the first corner, of the wedge is disposed at a second end of the winding axis 12. The interposition of the first insulating layer 26 means that the two layers 18, 22 are not exactly parallel to one another, but form an acute angle with one another, which results from the configuration of the first insulating layer 26. That side of the insulating layer 26 facing the second layer 22 has a number of steps 28. The width of one such step in the example respectively corresponds to three times the width of the electrical conductor 14.

The advantage of a first insulating layer 26 so configured is that it can be produced in a particularly simple manner.

The insulating material for producing the first insulating layer 26 is normally, likewise, in ribbon form. The width of the insulating material to be used can be determined, in a conventional manner, from its thickness, the cross-section to be filled, and the number of turns. In the example, the winding of the first insulating layer 26 should, then, be started at the first end of the winding axis 12 and the first layer 18. The ribbon insulating material can, now, be wound around the first layer 18 in the normal way, for example, in the manner described for the turns, between the first and the second end of the first layer 18, until the desired insulating layer thickness is achieved for a first step of the steps 28. The winding process in the area of the first step now ceases, with the ribbon insulating material now being wound only in the remaining axial area of the first layer 18, until the desired insulating layer thickness is achieved for a second step of the steps 28. It is, thus, possible to achieve a greater layer thickness step-by-step, until the last and, hence, thickest step is reached.

As an alternative thereto, an insulation material of specific width can be wound continuously at a feed rate that can be predetermined. In such a case, it is not absolutely required for the first, that is to say, the thinnest step, to, itself, form a closed layer, that is to say, the feed rate may be greater than the width of the material to be wound, if the turn insulation that is incorporated is already also sufficient for the insulation between two layers. The turn insulation is, in particular, the ribbon insulation material layer, which is applied to the electrical conductor, or is placed on the conductor in the form of ribbon material or as a film. If the feed rate is halved, this results in an insulating layer with twice the thickness. Stepped insulation can, thus, likewise be achieved in this way, without having to interrupt the insulating process in the meantime.

FIG. 1 also shows a third layer 30, constructed in a comparable manner to the first layer 18 and, as seen in the radially direction, is adjacent the second layer 22. A second insulating layer 32 is disposed between the third layer 30 and the second layer 22. The insulating layer 32 is configured substantially in the same way as the first insulating layer 26. However, the corner with the acute angle of the wedge-shaped second insulating layer 32 points towards the other end of the winding axis 12 rather than the first corner of the first insulating layer 26. The layer and the configuration of the first insulating layer 26 and of the second insulating layer 32 are chosen such that the radially outer side of the third layer 30 comes to rest precisely parallel to the winding axis 12. The principle of a configuration including a first insulating layer 26 and a second insulating layer 32 will be explained in more detail with reference to FIG. 2.

The winding structure shown here need not necessarily be wound around a winding core. It is perfectly feasible for the winding to be produced around a mandrel, which is removed once the winding has been produced. Such a winding structure provided according to the invention is used particularly successfully for a transformer or a coil rating of more than about 5 kVA. Typical values for the ribbon conductor material 16 may, for example, be widths of 20 mm with a thickness 0.1 mm, or widths of 150 mm with a thickness of 1 mm.

Figure 2:
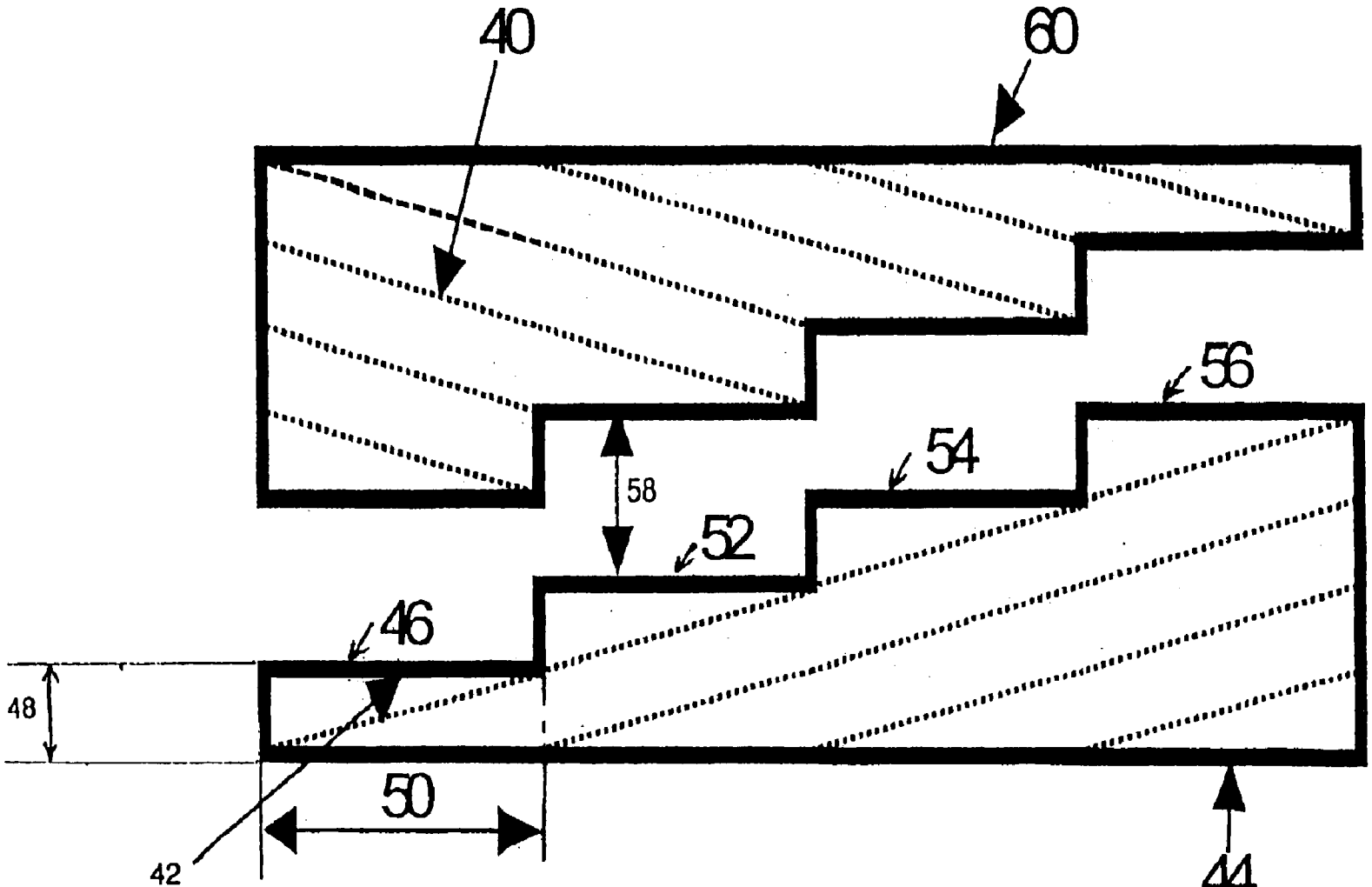
FIG. 2 is a fragmentary, cross-sectional view of two mutually opposite insulating layers according to the invention.

FIG. 2 shows a first insulating wedge 40 located opposite a second insulating wedge 42, and that could, in principle, be used as the first insulating layer 26 or as the second insulating layer 32. However, the figure shows only the basic configuration and the effect of the configuration of two insulating wedges 40, 42. To this extent, the dimensions and the size relationships in the figure are not to scale, and are also not comparable to the illustration in FIG. 1.

The second insulating wedge 42 has a base side 44. A first step 46, which has a first thickness 48 and a step length 50, is intended to be disposed at a first end of the base side 44. The first step 46 is adjacent to a second step 52, which is offset by the first thickness 48 with respect to the first step 46 so that the thickness of the second step 52 corresponds to twice the first thickness 48 overall. This is followed in the same way by a third step 54 and a fourth step 56, which are added to the first two steps 46, 52 to form a staircase-like shape, with the third step 54 having a thickness of three first layers 48, and the fourth step 56 having a thickness of four first steps 48. All the step lengths of the steps 46, 52, 54, 56 correspond to the step length 50. The upper faces of the steps, whose lengths are referred to as step lengths 50, are each disposed parallel to the base side 44.

The dimensions and structure of the first insulating wedge 40 correspond exactly to those of the second insulating wedge 42. However, in the view of FIG. 2, the section through the first insulating wedge 40 is rotated through 180° C. with respect to the second insulating wedge 42. Furthermore, the first insulating wedge 40 is positioned such that the respective step-shaped sides of the insulating wedges 40, 42 are located exactly opposite one another, and are disposed with a specific gap 58, parallel to one another.

In the example shown in FIG. 1, the first layer 18 could be disposed on the base side 44, with the second layer 22 being disposed between the insulating wedges 40, 42, and the third layer 30 being disposed opposite the base side of the first insulating wedge 40, which corresponds to the base side 44. FIG. 2 clearly shows that the base side 44 and the side 60 are parallel to one another and, accordingly, that the layers of windings that are opposite these sides, likewise, come to rest parallel to one another.

Figure 3:
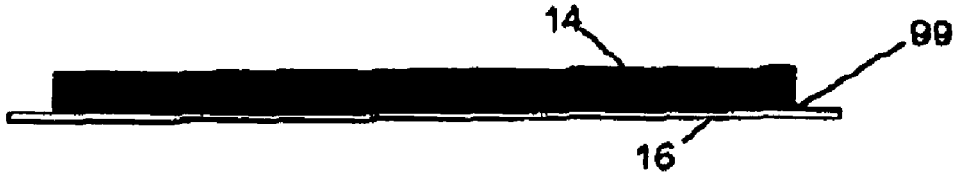
FIG. 3 is a side-elevational view showing a ribbon electrical connector connected to a ribbon insulating material via a connection.
Figure 4:
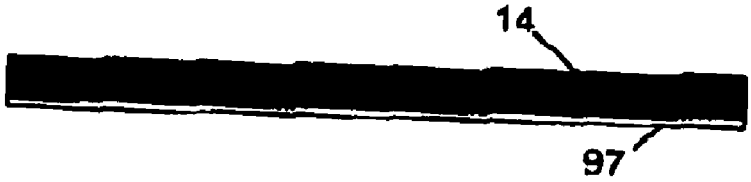
FIG. 4 is a side-elevational view showing a ribbon electrical connector coated with an insulating varnish.

FIG. 3 shows a ribbon electrical connector 14 connected to a ribbon insulating material 16 via a connection 99. FIG. 4 shows a ribbon electrical connector 14 coated with an insulating varnish 97.

We claim:

1. A winding for at least one of a transformer and a coil, comprising:

a winding core having a winding axis;

a ribbon electrical conductor;

an insulating material layer of ribbon insulation material;

said ribbon electrical conductor and said insulating material layer being wound synchronously to form turns around said winding core, individual ones of said turns of said winding:

being disposed to partially overlap one another; and having:

a predetermined winding angle with respect to said winding axis; and at least one of a local voltage differences and a voltage difference profile between each respective one of two radially adjacent layers of said turns in a direction of said winding axis; and insulating layers, at least one of said insulating layers disposed between each of two radially adjacent layers of said turns, each of said insulating layers having a thickness locally matched to respective one of said at least one local voltage differences and said voltage difference profile.

2. The winding according to claim 1, wherein a calculated overall thickness of two radially adjacent ones of said insulating layers has approximately the same thickness at every axial point due to a configuration of said two radially adjacent ones of said insulating layers.

3. The winding according to claim 1, wherein said insulating layers are disposed offset with respect to one another in a direction of said winding axis.

4. The winding according to claim 2, wherein said insulating layers are disposed offset with respect to one another in a direction of said winding axis.

5. The winding according to claim 1, wherein said thickness of each of said insulating layers changes stepwise in a direction of said winding axis.

6. The winding according to claim 1, wherein a change in said thickness of each of said insulating layers is continuous in a direction of said winding axis.

7. The winding according to claim 1, wherein, before said turns are wound, said electrical conductor is one of:

connected to said insulating material layer; and coated with an insulating varnish.

8. The winding according to claim 1, wherein said electrical conductor connected to said insulating material layer.

9. The winding according to claim 1, wherein said electrical conductor is insulating varnish coated.

10. A method for producing a winding for at least one of a transformer and a coil, which comprises:

synchronously winding a ribbon electrical conductor and an insulating material layer of ribbon insulation material to form turns around a winding core having a winding axis, each of the individual turns of the winding having a predetermined winding angle with respect to the winding axis and being disposed to partially overlap one another;

inserting an insulating layer between each two radially adjacent layers of the turns;

determining at least one of local voltage differences and a voltage difference profile between two respective adjacent ones of the radially adjacent layers in a direction of the winding axis; and locally matching a thickness of the insulating layer to a respective determined at least one of the local voltage differences and the voltage difference profile.

* * * * *